US009906855B2

(12) United States Patent
Lage et al.

(10) Patent No.: US 9,906,855 B2
(45) Date of Patent: Feb. 27, 2018

(54) REDUCING PORTED TRANSDUCER ARRAY ENCLOSURE NOISE

(71) Applicant: Bose Corporation, Framingham, MA (US)

(72) Inventors: Antonio M. Lage, Ashland, MA (US); Said Boluriaan, Acton, MA (US); Eric C. Mitchell, Upton, MA (US); Ray Scott Wakeland, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/981,380

(22) Filed: Dec. 28, 2015

(65) Prior Publication Data

US 2017/0188134 A1 Jun. 29, 2017

(51) Int. Cl.

| | |
|---|---|
| ***H04R 1/28*** | (2006.01) |
| ***H04R 1/40*** | (2006.01) |
| ***H04R 1/22*** | (2006.01) |
| *H04R 1/34* | (2006.01) |

(52) U.S. Cl.

CPC ..... *H04R 1/288* (2013.01); *H04R 1/227* (2013.01); *H04R 1/2803* (2013.01); *H04R 1/2811* (2013.01); *H04R 1/2826* (2013.01); *H04R 1/2849* (2013.01); *H04R 1/2857* (2013.01); *H04R 1/403* (2013.01); *H04R 1/345* (2013.01); *H04R 2201/401* (2013.01); *H04R 2203/12* (2013.01)

(58) Field of Classification Search

CPC . H04R 1/2811–1/2826; H04R 1/2838–1/2857; H04R 1/2869–1/2896; H04R 1/227; H04R 1/345; H04R 1/347; H04R 1/403; H04R 2201/40–2201/405; H04R 2203/12

See application file for complete search history.

(56) References Cited

U.S. PATENT DOCUMENTS

| | | | | |
|---|---|---|---|---|
| 3,047,090 A | | 7/1962 | Pruden | |
| 4,884,655 A | * | 12/1989 | Freadman | H04R 1/26 181/145 |
| 4,924,962 A | * | 5/1990 | Terai | H04R 1/2857 181/141 |

(Continued)

FOREIGN PATENT DOCUMENTS

| | | |
|---|---|---|
| EP | 1 577 880 | 9/2005 |
| WO | WO 2012/021713 | 2/2012 |

OTHER PUBLICATIONS

International Search Report and Written Opinion; PCT/WS2016/065375; dated Apr. 10, 2017; 16 pages.

*Primary Examiner* — Joshua Kaufman
(74) *Attorney, Agent, or Firm* — Fish & Richardson P.C.

(57) ABSTRACT

An apparatus includes an enclosure capable of receiving an array of transducers for converting electrical signals into steered audible signals. The apparatus also includes one or more structures within the enclosure defining a port having one end located within the enclosure and another end that is external to the enclosure. The apparatus also includes an acoustic resistive element located in the one of the one or more structures, the acoustic resistive element being capable of reducing effects of the acoustic characteristics of the port for audible signals being produced by the array of transducers.

10 Claims, 5 Drawing Sheets

(56) References Cited

U.S. PATENT DOCUMENTS

| | | | | |
|---|---|---|---|---|
| 5,821,471 | A * | 10/1998 | McCuller | H04M 1/035 181/156 |
| 7,565,948 | B2 | 7/2009 | Parker et al. | |
| 7,760,899 | B1 | 7/2010 | Graber | |
| 8,295,526 | B2 | 10/2012 | Bastyr et al. | |
| 8,351,630 | B2 | 1/2013 | Ickler et al. | |
| 8,358,798 | B2 | 1/2013 | Ickler et al. | |
| 2005/0094837 | A1* | 5/2005 | Parker | H04R 9/022 381/355 |
| 2012/0039475 | A1* | 2/2012 | Berardi | H04R 3/12 381/17 |
| 2014/0093113 | A1 | 4/2014 | Dix et al. | |

* cited by examiner

REDUCING PORTED TRANSDUCER ARRAY ENCLOSURE NOISE

TECHNICAL FIELD

This document relates to enclosures for transducers, in particular, designs for improving acoustical performance of ported transducer array enclosures.

BACKGROUND

Loudspeakers can be considered as including at least two primary components: a transducer that converts electrical signals into mechanical motion, and an enclosure designed to convert mechanical motion into radiated sound. While some enclosures are sealed, another enclosure design includes a port that allows air to pass between the interior and exterior of the enclosure. By incorporating a port, smaller enclosures can be produced that are efficient (in terms of the sound radiated for a given electrical power input), and more sensitive (in terms of the sound radiated for a given electrical signal input) relative to sealed enclosures.

SUMMARY

The disclosure provides a technique to improve the acoustical characteristics of a ported transducer enclosure with an array of transducers. By introducing an acoustic resistive element, acoustical characteristics (e.g., modes) of the port can be attenuated. Through the use of such a resistive element (or multiple elements), unwanted acoustic effects (e.g., spectral peaks of the port's signature appearing within the frequency band of the played content) can be reduced to improve the output sound produced by the individual speakers, beams formed by the speaker array, etc.

In one aspect, an apparatus includes an array of transducers for converting electrical signals into steered audible signals. The apparatus also includes an enclosure that includes each transducer in the array of transducers. The apparatus also includes one or more structures within the enclosure defining a port having one end located within the enclosure and another end that is external to the enclosure. The apparatus also includes an acoustic resistive element located in the one of the one or more structures, the acoustic resistive element being capable of reducing effects of the acoustic characteristics of the port for audible signals being produced by the array of transducers.

Implementations may include one or more of the following features. The acoustic resistive element may be configured to change the acoustical signature of one or more channels included in the port. The acoustic element may be shared by the port and another port included in the enclosure. The port may include a first channel portion and a second channel portion, the resistive element being located in a wall structure being shared by the first and second channel portions. The resistive element may be located in a wall structure being shared by a channel included in the port and the exterior of the enclosure. The acoustic resistance element may include a single layer. The acoustic resistance element may include multiple layers. The acoustic resistance element may include a layer of fabric material. The acoustic resistance element may include a metallic mesh. The acoustic resistance element may be generally rectangular in shape.

In another aspect, an apparatus includes an array of transducers for converting electrical signals into steered audible signals. The apparatus also includes an enclosure that includes each transducer in the array of transducers. The apparatus also includes one or more structures within the enclosure defining a port having one end located within the enclosure and another end that is external to the enclosure. The apparatus also includes an acoustic resistive element located in the one of the one or more structures, the acoustic resistive element being capable of reducing effects of the acoustic characteristics of the port for audible signals being produced by the array of transducers.

Implementations may include one or more of the following features. The acoustic resistive element may be configured to change the acoustical signature of one or more channels included in the port. The acoustic element may be shared by the port and another port included in the enclosure. The port may include a first channel portion and a second channel portion, the resistive element being located in a wall structure being shared by the first and second channel portions. The resistive element may be located in a wall structure being shared by a channel included in the port and the exterior of the enclosure. The acoustic resistance element may include a single layer. The acoustic resistance element may include multiple layers. The acoustic resistance element may include a layer of fabric material. The acoustic resistance element may include a metallic mesh. The acoustic resistance element may be generally rectangular in shape.

Other features and advantages will be apparent from the description and drawings, and from the claims.

DESCRIPTION OF DRAWINGS

Like reference symbols in the various drawings indicate like elements.

DETAILED DESCRIPTION

Figure 1:
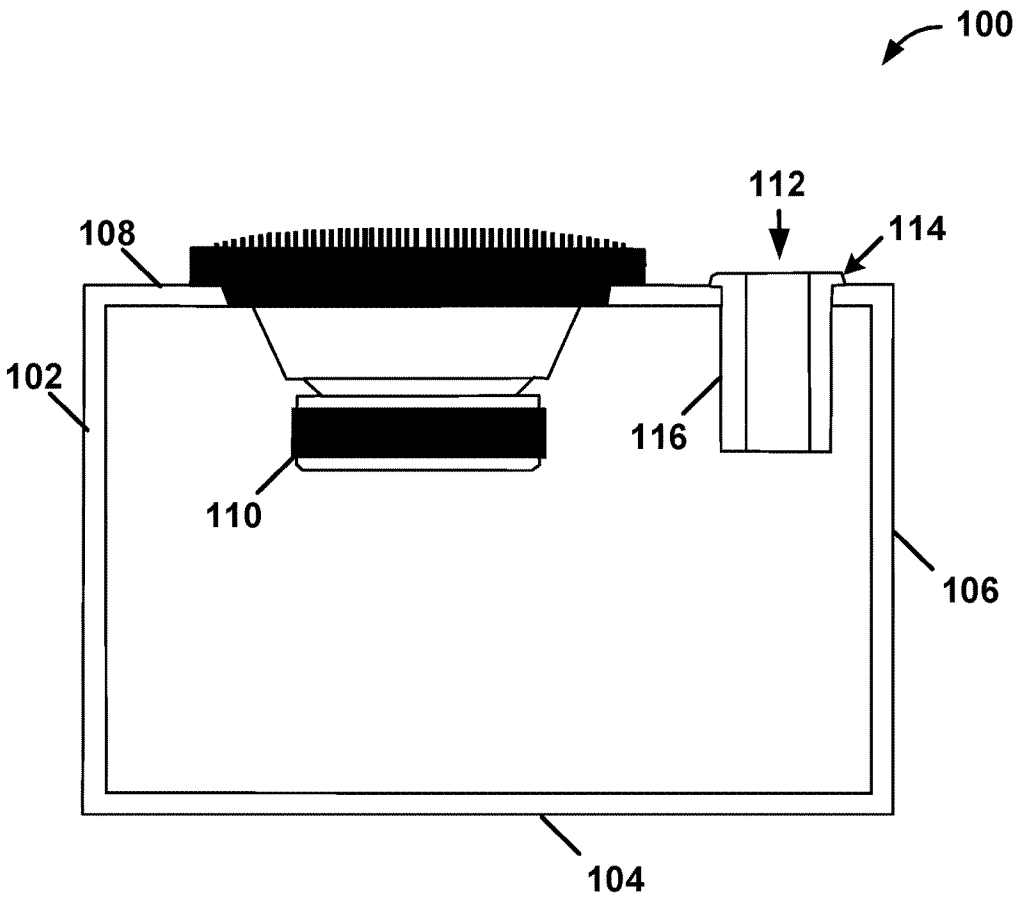
FIG. 1 is a cross sectional view of a ported speaker enclosure.

Referring to FIG. 1, a cross sectional view of a ported enclosure 100 of a loudspeaker is presented that includes four walls 102, 104, 106, 108 that generally define the structure of the enclosure. In this arrangement, a transducer that converts electrical signals into audible signals (transducer 110) is mounted into the upper wall 108; however, the transducer may be oriented differently in other examples. To allow air to freely flow between an acoustic volume defined by the enclosure 100 (i.e., an interior of the enclosure) and the environment of the exterior of the enclosure, a port 112 is incorporated into the upper wall 108 of the enclosure. In this particular example the port is realized by a cylindrical structure; however, other designs (e.g., different shapes, cross sections, etc.) may be employed. In general, the port 112 includes a port interface 114 that allows air to enter the port from the ambient environment and to exit the port. The port 112 also includes a port channel 116 that directs the air into and out of the interior of the enclosure.

In general, ports can have undesirable acoustical attributes that enclosure designs may address (e.g., minimize) to provide appropriate performance and still be relatively small in size. By allowing air flow through the port, unwanted noise and distortion can be produced. For example, the geometry of the port (e.g., port channel length) can produce acoustic standing waves that may alter the desired frequency response of the loudspeaker by introducing resonances, reinforcing noise and/or distortion, etc. through excitation of the standing waves. In arrangements in which the volume of the port is a considerable portion of the entire enclosure volume (e.g., port volume is 50% or more of the enclosure volume), standing waves in the port can occur at frequencies that are within the operating band of the loudspeaker (that includes the port and the transducer(s)). Through controlling techniques (e.g., damping), their corrupting effects can be reduced. Additionally, by properly dampening of such standing waves, the waves and/or resonances can be exploited to improve (e.g., increase) the output, efficiency, etc. of the loudspeaker.

The introduction of computer-aided modeling and design, computational analysis (e.g., finite element analysis), advanced manufacturing processes and materials, etc. have allowed ported enclosures to be designed with higher levels of quality and improved frequency responses compared to sealed enclosure designs. Along with the layout of the enclosure itself (e.g., transducer location, etc.) and other design parameters (e.g., enclosure size, materials employed such as wall linings, etc.), the design of the port to allow air flow (to and from the enclosure's interior) can affect the overall performance of the loudspeaker.

As mentioned above, the port 112 can contribute to noise being added output of the loudspeaker (that includes the enclosure 100 and the transducer 110). In particular, both the port interface 114 and the port channel 116 can cause the introduction of resonances, standing waves, etc. that may be considered noise sources. For example, resonant tones may be excited by the port interface's structure, the structure of the port channel, etc. Such noise tones can be particularly distracting to a listener when the spectral range of the audible content being played-back by the speaker includes the frequencies of the resonant tones. For example, the bass tones of the content may be affected by the tonal resonance, standing waves, etc. and thereby corrupt playback. Along with affecting the performance of a single transducer enclosure, the performance of an enclosure containing multiple transducers may be degraded. Other types of enclosures may also be affected in similar manners. For example, waveguide type enclosures can be considered as a port that consumes nearly the entire volume of the enclosure (e.g., a small percentage of an enclosure, 10%, is used by the transducer or transducer in the enclosure). Similar to the illustrated enclosure, standing waves may form in waveguide enclosures and potentially corrupt the output of the loudspeaker. Examples of such waveguides are described in U.S. Pat. No. 7,565,948, entitled "Acoustic Waveguiding," and U.S. Pat. No. 8,295,525, entitled "Low Frequency Enclosure for Video Display Devices," both of which are incorporated by reference in their entirety, herein.

Figure 2:
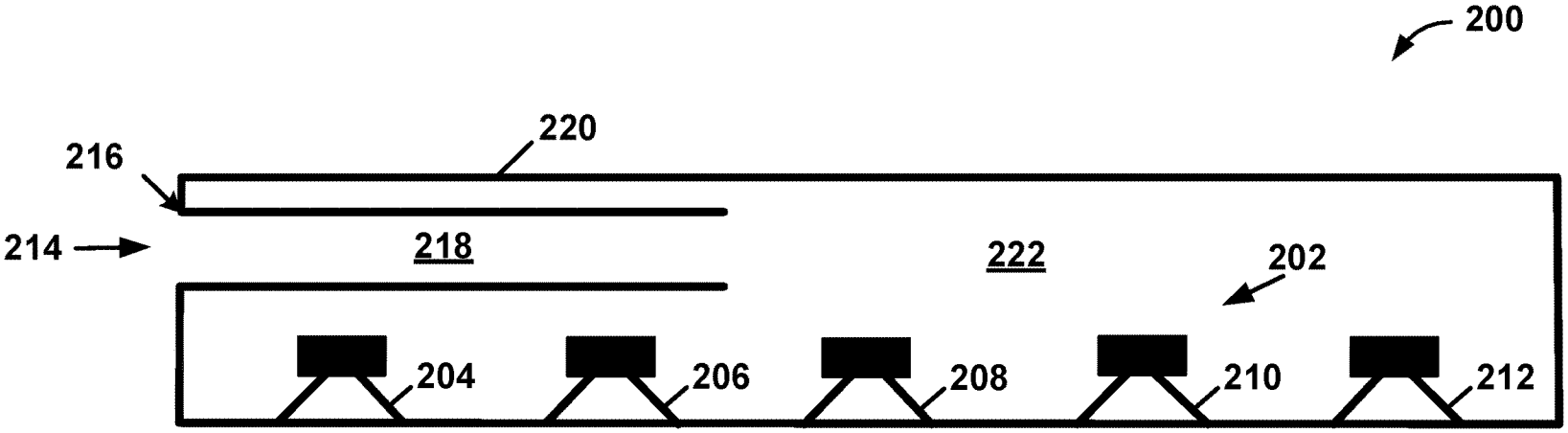
FIG. 2 is a graphical representation of a ported enclosure for an array of transducers.

Referring to FIG. 2, a graphical representation illustrates the cross section of a ported enclosure design for multiple transducers. In this example, an enclosure 200 includes an array of transducers 202 (e.g., five transducers 204, 206, 208, 210, 212) and a port 214. The port 214 includes a port interface 216 and a port channel 218 that allows air to flow between the interior of the enclosure 200 and the ambient environment external to the enclosure. In particular, the port channel 218 begins at the port interface 216 and extends along a back wall 220 of the enclosure before opening into a cavity 222 that contains the transducer array 202. In some arrangements, the enclosure 200 can be utilized in producing a sound bar product (also referred to as a media bar) that can produce a multi-channel surround effect while using a single enclosure. For such a sound bar device, the multiple transducers are often orientated along a particular dimension (e.g., along the horizontal direction or vertical direction). Often the orientation of the speakers is determined for acoustic effects of interest, the mounting location of the sound bar (e.g., above or below a display device such as a television, computing device display, etc.).

Similar to the single transducer enclosure shown in FIG. 1, both the port interface 216 and the port channel 218 can be noise sources capable of effecting the performance of the enclosure 200 of the transducer array 202. For example, at some frequencies (e.g., tens of hertz and above), standing waves may form in the port 214 based upon the movement of air within the open-ended channel created by the port. The acoustic effects of such standing waves may appear at various frequencies (e.g., 1 KHz, etc.) that are also included in the spectrum of the audio content being played, thereby potentially corrupting the audible signals being produced by the enclosure 200. Additionally, these noise sources can also effect the output of the transducer array 202. For example, beamforming operations may be executed upon the signals input to the individual transducers 204-212, for example, to steer an audible signal in one or more directions, to one or more locations external to the enclosure, etc. Since the phase of the noise created by the port components is difficult to control, a steered beam (or beams) produced by the transducer array 202 can potentially be affected and the acoustic quality of the audio content being produced can be degraded (along with the listening experience).

Figure 3:
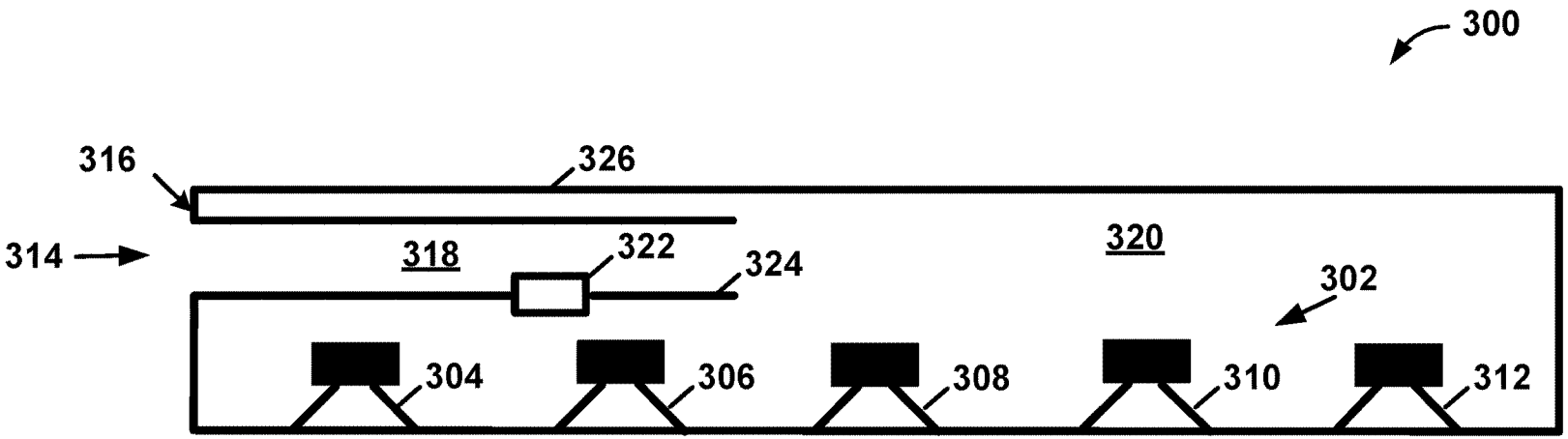
FIG. 3 is a graphical representation of a ported enclosure for an array of transducers that includes an acoustic resistive element.

Referring to FIG. 3, one or more techniques may be implemented to reduce the effects of the port noise sources from corrupting the acoustics of the individual speakers and the overall performance of the transducer array. For example, one or more elements that reduce acoustical effects may be incorporated into one or more structures (e.g., a wall) that define the port components (e.g., port channel) of the transducer array enclosure. An enclosure 300 is illustrated that includes a transducer array 302 (including five transducers 304, 306, 308, 310, and 312) and a port 314 that includes a port interface 316 and a port channel 318 (that has one end at the port interface and another end that opens into a cavity 320 that contains the transducer arrange 302). To reduce the effects of one or more standing waves that form based upon the acoustical characteristics of the port 314, a resistive acoustic element 322 is incorporated into a structure (e.g., wall structure 324) to reduce the acoustic resonant features of the port interface 306, the port channel 318, etc. In this illustration, the geometry (e.g., size, shape, etc.) of the element 322 is graphically illustrated to visually highlight the element. For example, the element 322 is illustrated as extending outward from both surfaces of the wall structure 324; however, in various implementations the geometry of the element may be designed such that the element is substantially flush to one or both wall surfaces. For example, the element 322 may be a screen incorporated into the wall. In general, to reduce the acoustical effects, the sound pressure difference across the element may be low (e.g., the difference between the sound pressure present at the port channel 318 side of element 322 and the sound pressure present at the cavity 320 side of element 322 near transducer 306).

In this illustrated example, a single acoustic resistive element is incorporated into the wall structure 324; however additional elements may similarly be incorporated into the wall. Also, one or more resistive elements may be incorporated into other structures of the port channel 318; for example, one or multiple resistive elements may be included in a wall structure shared by the port channel and another portion of the enclosure 300. In one arrangement, one or more elements can be incorporated into an exterior wall structure (e.g., wall 326) that is shared with the port channel 318. Similar positions on each wall structure may be selected for incorporating such resistive elements, or, different position locations may be selected for multiple elements.

Various types of design parameters of the elements may be adjusted to reduce the acoustical characteristics of a port (e.g., port interface, port channel, etc.). For example, the size and shape of one or more elements may be adjusted. Similarly the orientation of the elements (as embedded in wall structures) may be adjusted (e.g., translated, rotated, etc.) individually or in concert (e.g., to create particular patterns) to address certain resonance effects.

Various types of structures may be employed for producing one or more acoustic resistive elements. For example, a single layer element (e.g., a single layer screen) or a multi-layer element (e.g., stacked screens) may be designed and used. For a multi-layer resistive element, one or more separation distances may be employed for the design. Further, air may be allowed to flow between the multiple layers, or, one or more materials may be used to create structures between the screens. For example, different patterns (e.g., ridges, channels, etc.) may be incorporated into structures positioned between screen pairs. Such screens can also incorporate one or more geometries (e.g., generally rectangular shapes, etc.).

Various types of materials may be used for producing resistive elements to dampen the effects of the acoustical characteristics of the port interfaces and channels. For example, one or more screens included in the resistive element 322 may be metallic in composition and include one or more metals (along with other types of materials in some arrangements). A substantially solid metal layer (or layers) may be used to produce a screen. Meshes and other types of pattern designs may be employed in one or more screens. One or more fabrics may be employed in the resistive element; for example, a relatively stiff fabric may be used that is capable to withstanding the environmental effects (e.g., temperatures, sound pressures, vibrations, etc.) of the transducer array enclosure 300. Composite materials may also be used to create a screen, a screen frame, or other structural components of the resistive element 322. Combinations of different materials may also be used for producing components of the resistive element 322; for example, one or more composites (e.g., plastics) and metals may be employed.

Figure 4:
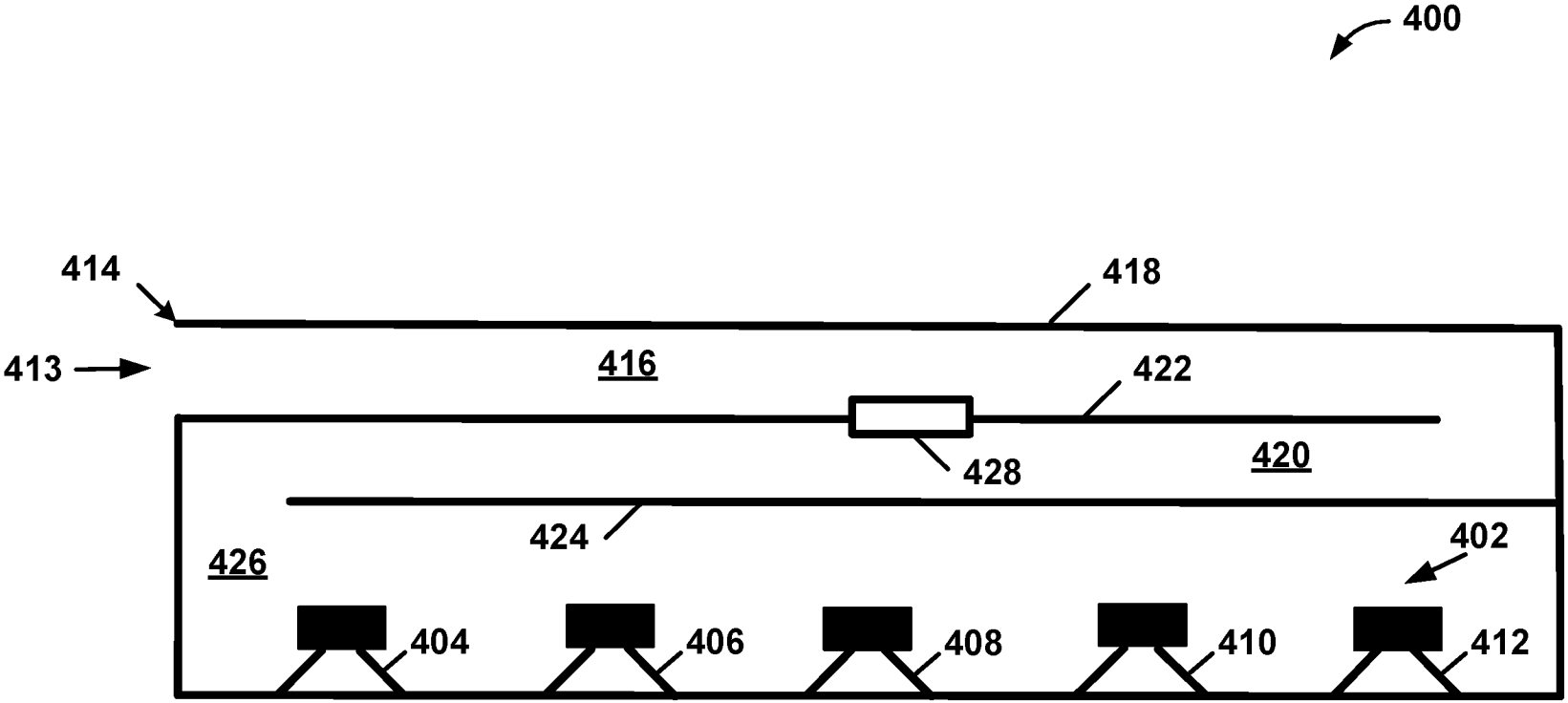
FIG. 4 is a graphical representation of a ported enclosure for an array of transducers that incorporates an acoustic resistive element into a wall structure shared by two port channel segments.

Referring to FIG. 4, a graphical representation illustrates the cross section of another transducer array enclosure design. In this example, an enclosure 400 includes a transducer array 402 (including transducers 404, 406, 408, and 410) and a relatively more complex port (compared to the cylindrical shaped port 112 of FIG. 1). A port 413 includes a port channel comprised of a series of segments that produce a pathway that alternates in direction. In this example, a port interface 414 (that interfaces the enclosure 400 to the exterior environment) is followed by a first segment 416 of the port channel and extends from left to right along a back wall 418 of the enclosure. After a 180 degree turn, a second segment 420 of the port channel extends along the first segment 416 (in the opposite direction). Being adjacent, the two segments 416 and 420 share a common wall structure 422 within the interior of the enclosure. Moving along the port channel segment 420 (from right to left) between the wall structure 422 and an opposite wall structure 424, after another turn the segment opens into a cavity 426 that contains the transducer array 402. Similar to the port interfaces and channels shown in FIGS. 1-3, the overlapping segment design of the port 413 (e.g., the port interface 414, and the multiple segments of the port channel) can be a noise source capable of limiting the performance of transducer array. For example, at some frequencies (e.g., tens of hertz), standing waves may form in the port 413 based upon the movement of the air within the open-ended channel created by the port. The acoustic effects of such standing waves may appear at frequencies (e.g., 1 KHz, etc.) which may also be included in the spectrum of the playback content, thereby potentially corrupting the produced sound. Further, such standing waves may affect the beamforming capabilities of the transducer array 402.

To reduce the effects of one or more standing waves that form based upon the acoustical characteristics of the port 413, a resistive acoustic element 428 is incorporated into the shared wall structure 422 to reduce the acoustic resonant features of the port interface 414, the port channel (e.g., segments 416, 420), etc. that could affect the performance of the transducer array 402.

In this example, a single acoustic resistive element is incorporated into the wall 422; however additional elements may similarly be incorporated into the wall. Also, one or more resistive elements may be incorporated into other structures of the port channel segments; for example, one or multiple resistive elements may be included in other wall structures. For example, one or more elements can be incorporated into wall structure 418 that is shared by the port channel segment 416 and the exterior environment of the enclosure 400. In another example, one or more elements may be embedded in the wall structure 424 that is shared by port channel segment 420 and the cavity 426 (within which the transducer array 402 is mounted). Similar positions on each wall structure may be selected for incorporating such resistive elements, or, different position locations may be selected for two or more elements. As mentioned above, different geometries, materials, features (e.g., single layer, multi-layer, etc.), and other designs may be employed in the acoustic resistive elements.

Figure 5:
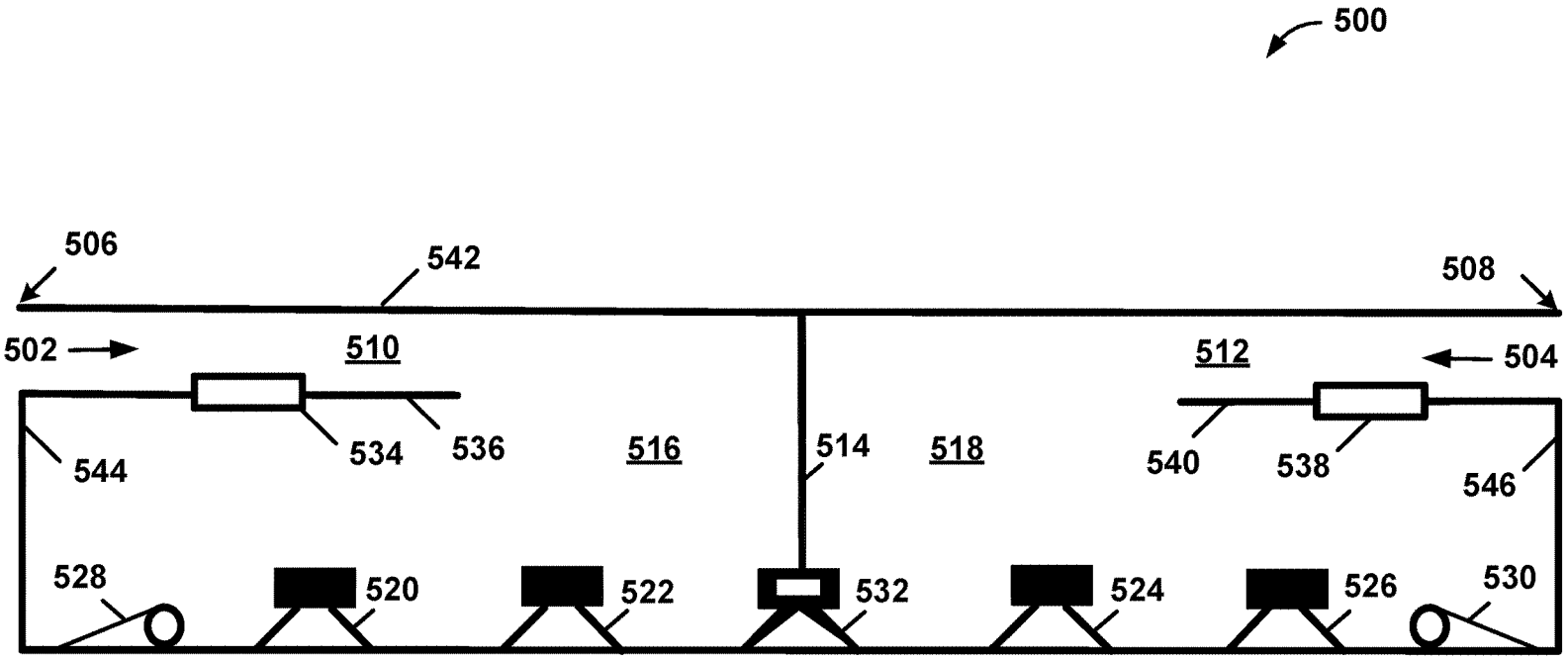
FIG. 5 is a graphical representation of a ported enclosure for an array of transducers that includes acoustic resistive elements incorporated into multiple wall structures.

Referring to FIG. 5, different types of ported speaker array enclosures may employ acoustic resistive elements, such as designs that include multiple ports, multiple speaker cavities, etc. An example of a multiple port design that employs one or more acoustic resistive elements is described in U.S. patent application Ser. No. 14/981,546, titled "Acoustic Resistive Elements for Ported Transducer Enclosure" filed on 28 Dec. 2015, which is incorporated by reference in its entirety herein. In this illustrated example, a transducer enclosure 500 (e.g., for a sound bar design) includes two separate ports within which acoustic resistive elements may be positioned to improve the enclosed transducer array performance. Ports 502 and 504 respectively include port interfaces 506, 508 and port channels 510, 512. In this example, a wall structure 514 separates the two ports 502 and 504; however, other design variants may be employed to separate the ports. Each of the port channels respectively opens into cavities 516 and 518 that contain transducers of an array for sound production. Each cavity contains two transducers (e.g., cavity 516 includes transducers 520 and 522, and, cavity 518 includes transducers 524 and 526). Additionally, each cavity includes other types of device for producing sound; for example, transmission tubes 528 and 530 that are capable of steering sound in particular directions. Examples of such transmission tube devices are described in U.S. Pat. No. 8,351,630 entitled "Passive Directional Acoustical Radiating" and U.S. Pat. No. 8,358,798 entitled "Passive Directional Acoustical Radiating," both of which are incorporated by reference in their entirety herein. Another transducer 532 (e.g., a tweeter speaker) is also included in the enclosure and may or may not be included within an array that uses the mounted speakers.

In this arrangement, to reduce the acoustic effects of the ports (e.g., port 502 and port 504), the cavities (e.g., cavities 516 and 518), etc., one or more acoustic resistive elements can be embedded in structures (e.g., wall structures) within the enclosure 500. In this particular example, acoustic resistive elements are incorporated into respective wall structures of the two ports 502 and 504. In particular, one resistive element 534 is incorporated into a wall structure 536 that is shared by port channel 510 and cavity 516, and, another resistive element 538 is incorporated into a wall structure 540 that is shared by port channel 512 and cavity 518. By being embedding in these respective locations, each resistive element is capable of reducing the sound pressure differential between the respective port channel and cavity. Such acoustic elements may be positioned in other locations within the transducer array enclosure 500; for example as mentioned above one or more elements may be embedded in other structures. In some arrangements, an element (or elements) may be incorporated into a wall structure 542 that is shared by a port channel (e.g., port channel 510) and the environment external to the enclosure 500. Similarly elements may be positioned in wall structures that are shared between the cavities (e.g., wall structure 514), positioned in a wall structure shared by a cavity and the exterior of the enclosure 500 (e.g., wall structure 544, 546, etc.), etc.

As illustrated in the figure, two ports 510 and 512 are employed to allow air flow between the exterior of the enclosure 500 and the enclosure's interior. In some designs, a single port or more than two ports may be used to provide air flow path(s). Such designs can produce noise sources that may corrupt the sound out of the enclosure. To reduce potentially corrupting acoustics, one or more lossy material acoustic resistive elements may be incorporated into one or more structures (e.g., wall structures) of these designs. Similar to previously described designs, to reduce such affects the resistive element may be a screen, a stack of screens (e.g., a multi-screen design), etc. that is embedded to be substantially flush to the surfaces of both sides of the wall structure. As mentioned above, the resistive element may incorporate a variety of designs, use various design parameters (e.g., geometries, materials, orientations, positioning), etc. For example, a resistive element may be provided by (or incorporated into) a three dimensional design (e.g., a tubular structure) that connects portions of an enclosure that do not share a structure (e.g., wall structure). While one resistive element may be incorporated into a wall structure (e.g., a shared wall structure), additional resistive elements can be incorporated into the wall; for example, multiple resistive elements (e.g., oriented in a particular pattern) can be embedded in the wall. Along with at least one resistive element being incorporated into a shared wall structure (or other types of structural component shared by the ports), multiple resistive elements may be incorporated at other locations of the transducer array enclosure; for example, resistive elements into wall structures 514, 542, 544, 546, etc. to reduce the potential corrupting of the output of the transducers included in the enclosure 500 (e.g., the transducer array). Similarly, different designs, design parameters, etc. may be used to reduce acoustical modes caused by the ports, cavities and other enclosure portions that may affect the content being played by a transducer array.

Many other implementations other than those described may be employed, and may be encompassed by the following claims.

What is claimed is:

1. An apparatus comprising:

a first enclosure comprising a first array of transducers, and a first passive directional acoustic element;

a second enclosure comprising a second array of transducers, and a second passive directional acoustic element;

a wall shared between the first enclosure and the second enclosure;

a transducer, separate from the transducers in the first array or the second array, disposed at a boundary between the first enclosure and the second enclosure such that the wall and the transducer separate the first enclosure from the second enclosure;

one or more structures within the first enclosure defining a first port having one end located within the first enclosure and another end that is external to the first enclosure;

one or more structures within the second enclosure defining a second port having one end located within the second enclosure and another end that is external to the second enclosure;

a first acoustic resistive element located in one of the one or more structures defining the first port, the first acoustic resistive element configured to reduce effects of one or more standing waves on audible signals produced by the first array of transducers, the effects being reflective of acoustic characteristics of the first port; and a second acoustic resistive element located in one of the one or more structures defining the second port, the second acoustic resistive element configured to reduce effects of one or more standing waves on audible signals produced by the second array of transducers, the effects being reflective of acoustic characteristics of the second port.

2. The apparatus of claim 1, wherein each of the first and second acoustic resistive elements is configured to change acoustical signatures of corresponding one or more channels included in the port.

3. The apparatus of claim 1, wherein each of the first and second ports includes a first channel portion and a second channel portion, the corresponding one of the first or second acoustic resistive elements being located in a wall structure being shared by the first and second channel portions.

4. The apparatus of claim 1, wherein each of the first and second resistive elements is located in a wall structure being shared by a channel included in the corresponding port and the exterior of the corresponding enclosure.

5. The apparatus of claim 1, wherein each of the first and second acoustic resistive element includes a single layer.

6. The apparatus of claim 1, wherein each of the first and second acoustic resistive element includes multiple layers.

7. The apparatus of claim 1, wherein each of the first and second acoustic resistive element includes a layer of fabric material.

8. The apparatus of claim 1, wherein each of the first and second acoustic resistive element includes a metallic mesh.

9. The apparatus of claim 1, wherein each of the first and second acoustic resistive element is generally rectangular in shape.

10. The apparatus of claim 1, wherein each of the first and second passive directional acoustic elements comprises a transmission tube.

* * * * *